United States Patent [19]

Katoogi

[11] 4,350,929

[45] Sep. 21, 1982

[54] FLUORESCENT LIGHTING DEVICE

[75] Inventor: Masayuki Katoogi, Tokyo, Japan

[73] Assignee: Moriyama Sangyo Kabushiki Kaisha, Tokyo, Japan

[21] Appl. No.: 100,001

[22] Filed: Dec. 4, 1979

[30] Foreign Application Priority Data

| | | | |
|---|---|---|---|
| Dec. 6, 1978 | [JP] | Japan | 53-151800 |
| Jan. 14, 1979 | [JP] | Japan | 54-3497 |
| Mar. 13, 1979 | [JP] | Japan | 54-28860 |
| Jul. 4, 1979 | [JP] | Japan | 54-84742 |

[51] Int. Cl.[3] ..... H01J 7/44; H01J 13/46; H01J 19/78; H01J 29/96

[52] U.S. Cl. ..... 315/49; 315/DIG. 1; 315/DIG. 5; 315/61; 315/63; 315/101; 315/105; 315/179; 315/290

[58] Field of Search ..... 315/46, 47, 49, 50, 315/57, 61, 63, 70, 74, 106, DIG. 5, DIG. 1, 100, 101, 102, 103, 105, 177, 189, 290, 179

[56] References Cited

U.S. PATENT DOCUMENTS

| | | | |
|---|---|---|---|
| 2,586,402 | 2/1952 | Waguet | 315/290 |
| 2,644,108 | 6/1953 | Claude | 315/179 X |
| 3,059,137 | 10/1962 | Reaves | 315/46 X |
| 3,315,123 | 4/1967 | Furui | 315/106 X |
| 3,336,501 | 8/1967 | Segawa | 315/105 |
| 3,476,976 | 11/1969 | Morita et al. | 315/101 |
| 3,644,780 | 2/1972 | Koyama et al. | 315/101 |
| 3,665,243 | 5/1972 | Kaneda et al. | 315/105 |
| 3,701,925 | 10/1972 | Nozawa et al. | 315/DIG. 5 |
| 3,836,816 | 9/1974 | Heck | 315/DIG. 5 |
| 3,974,418 | 8/1976 | Fridrich | 315/100 |
| 4,064,416 | 12/1977 | Krense et al. | 315/60 |
| 4,092,562 | 5/1978 | Campbell | 315/DIG. 5 |
| 4,100,462 | 7/1978 | McLellan | 315/179 |
| 4,165,475 | 8/1979 | Pegg et al. | 315/DIG. 5 |
| 4,204,139 | 5/1980 | Shimer et al. | 315/DIG. 5 |
| 4,223,247 | 9/1980 | Jacobs et al. | 315/57 |
| 4,297,616 | 10/1981 | Corona | 315/DIG. 5 |

FOREIGN PATENT DOCUMENTS

| | | | |
|---|---|---|---|
| 118721 | 1/1947 | Sweden | 315/49 |

*Primary Examiner*—Saxfield Chatmon, Jr.
*Attorney, Agent, or Firm*—Spencer & Kaye

[57] ABSTRACT

A fluorescent lighting device which includes a preheating type fluorescent discharge tube and as the ballast thereof an incandescent bulb. The fluorescent lighting device is ignited by the use of a pulse transformer and a neon tube. A semiconductor element may be used in place of the neon tube.

15 Claims, 31 Drawing Figures

FLUORESCENT LIGHTING DEVICE

BACKGROUND OF THE INVENTION

1. Field of the Invention

The present invention relates to a fluorescent lighting device, and in particular, to a lighting device including a fluorescent discharge tube and a resistance ballast, such as an incandescent bulb, for the discharge tube.

According to the recent need for the economy of power, the efficiency of a fluorescent discharge tube has been noted compared with an incandescent bulb for room illumination or commercial display. The color rendering of the fluorescent discharge tube has been improved to provide emission from the fluorescent tube having a natural color or as natural as the incandescent bulb. In view of this improvement in the color rendering, the use of the fluorescent discharge tube in place of the incandescent bulb has been made easier.

There is much difference between the shape of an incandescent bulb lighting device and a fluorescent discharge tube lighting device because of differences in the light sources and the igniting devices. Selection of them has therefore been made according to the place and purpose of use. The achievement of interchangeability between the two lighting devices has not been easy.

In order to use a fluorescent lighting device in place of an incandescent bulb, an independent means for connection, etc. must be provided. For example, additional wiring is required. If it is possible to use the fluorescent discharge tube with the ordinary incandescent bulb illuminating device, demand for the fluorescent discharge tube will increase, which is advantageous for the economy of power.

In some fluorescent discharge tubes, preheating of the discharge electrodes included therein is necessary for starting. In order to stably ignite the preheating type fluorescent discharge tube, it is necessary to include a preheating current control means within the power supply circuit for ignition. As such means, a choke ballast system has been employed using a choke coil for the stabilizer. Other than this system, the resistance ballast system using a resistor wire or an incandescent bulb is known.

In order to ignite a fluorescent discharge tube of this type, it is necessary to include a preheating circuit for preheating the discharge electrodes of the discharge tube before starting the discharge and also a kick voltage generator circuit for obtaining a high starting voltage.

2. Description of the Prior Art

In the preheating circuit, it is necessary to use switching means for closing the current circuit to supply current to the filaments of the discharge electrodes for a very short period at the initial stage of the igniting operation. A glow bulb has been used for this switching means. Also, a manual switch has been used for a desk electric stand, etc. which can be manually controlled.

According to the choke ballast system, a high voltage resulting from the self-inductance of the stabilizer caused by the cut-off of the current at the end of the preheating operation has been used in the kick voltage generating circuit. On the other hand, according to the resistance ballast system, a high voltage generator circuit, such as a transistor inverter has been separately provided. For a small discharge tube less than 20 W, simple means has been proposed in which the line voltage is directly applied to a conductor provided in the vicinity of the outer wall of the discharge tube.

These ballasts are used to assure a stable tube current and proper preheating current. The above mentioned choke ballast system meets these demands. However, a wide inner space within the body is required for mounting the stabilizer, etc. In order to protect the fluorescent tube against the heat generated by the chalk coils, the fluorescent tube must be separated from the choke coils. The structure of the device itself is therefore limited and there is less freedom in the design of the device. With the heavy choke coils, the weight of the entire device becomes greater. Further, there are problems due to the rather loud hum noises generated by the stabilizer.

On the other hand, in the resistance ballast system, the above problems due to the stabilizer are solved, and in particular, when an incandescent bulb is used as the ballast, the bulb itself emits light, which is advantageous in the improving of the color rendering. The power factor of the device and efficiency are also improved. Also, the bulb filament of the incandescent bulb can protect the fluorescent tube against the abnormal circuit current.

The resistance ballast system requires a kick voltage generator circuit, which detects the voltage between the discharge electrodes at the end of the preheating operation and applys a high voltage between the discharge electrodes to start the discharge therebetween. While the discharge continues, the generating operation must be stopped to prevent the consumption of power and to stabilize the discharge current (the tube current). In order to fulfil this condition of operation, complicated electronic circuits have been required, and this has resulted in a higher production cost.

SUMMARY OF THE INVENTION

The inventor of this invention has developed a fluorescent lighting device with a base directly adaptable to a receiving socket for an ordinary incandescent bulb, in order to utilize the already provided devices for the incandescent bulb, in view of the above mentioned characteristics of the fluorescent tube when used in place of the existing incandescent lighting device.

The fluorescent lighting device having a base thus developed uses a glow starter and a choke stabilizer for an igniting circuit, and a fluorescent discharge tube and the igniting circuit are covered with a light-transmitting globe of synthetic resin material, so as to provide an appearance similar to the conventional incandescent lighting device. The objective is to provide a device which does not make the user feel uneasy, and also provide interchangeability of the fluorescent discharge tube with the existing means for the incandescent bulb.

The choke stabilizer is heavy in its weight. In the above fluorescent discharge tube with a base including the choke stabilizer therewithin, the socket must receive and bear by itself the entire load consisting of the stabilizer and the fluorescent discharge tube, etc. through the base of the lighting device. In order to avoid accidental falling of the device from the socket, the entire weight of the device must be reduced. In such case the choke stabilizer which is the heaviest component in the device must be replaced with a smaller one. When a larger fluorescent tube is used, a choke stabilizer having high wattage must be used, and therefore the weight of the device increases. And moreover, a large amount of heat is generated thereby, which considerably raises the temperature within the globe of the device. This might reduce the efficiency of the fluorescent discharge tube. In view of this, a fluorescent lighting device with a base is practical when it is used with a tube of relatively low wattage (about 20 W or less).

The inventor of this application then noted the resistance ballast system using an incandescent bulb, in order to provide a large fluorescent lighting device of about 30 or 32 W with less loading of the device and with improved efficiency.

As already explained, the resistance ballast system has been known as a means for controlling the current in a fluorescent discharge tube. In order to start the ignition in the fluorescent discharge tube, a discharge start voltage (a kick voltage) which is several tens of times the line or lighting voltage is required between the cathodes of the fluorescent discharge tube at the end of the preheating operation. A discharge start voltage generator is therefore provided separately according to this resistance ballast system. This voltage generator detects the return of the voltage between the cathodes to the line voltage at the completion of the preheating operation and applys a high voltage between the discharge electrodes at this stage to start the discharge between the electrodes. On the other hand, the generating operation thereof must be stopped during discharging in order to save power by the operation of the generator and in order to stabilize the igniting current. In order to meet these requirements, complicated electronic circuits have been used in the conventional devices.

The inventor of this invention has developed a circuit device for starting the discharge which has a very simple circuit construction and solves the problems above mentioned. According to this method, an auxiliary electrode is mounted on the outer wall of the fluorescent discharge tube and the ignition start is made by applying a high voltage to the auxiliary electrode. The connection between the auxiliary electrode and the discharge cathodes is a stray capacitive connection having a high impedance and therefore it requires very little current. In this new lighting device, a small pulse transformer is used, and its primary coil receives a surge voltage at the time the glow starter, circuit is opened while a high voltage generated in the secondary coil of the pulse transformer is applied to the auxiliary electrode. Thus the inventor of this invention has provided a simplified and efficient circuit device comprising the auxiliary electrode and a very small pulse transformer in place of the conventional discharge start voltage generator. In order to stably ignite the fluorescent discharge tube, the starting of the igniting operation must be good, and further good repeated igniting operation must be assured at every half cycle of the AC power source after the ignition of the lighting device.

The stable lighting condition of a lighting device using a choke stabilizer after the ignition start operation will now be explained with reference to the graph of FIG. 1. The curve V shows the voltage of an AC power source. The curve Vd and the curve I are respectively the tube voltage and tube current applied between the electrodes of the fluorescent discharge tube. There arises a phase difference due to the inductance of the stabilizer. When the tube current I of the offset phase is zero, a counter electromotive force is generated in the stabilizer in the direction opposite to the flow of the current. The voltage generated at this time is sufficient for the ignition of the next half cycle applied to the fluorescent discharge tube, and the fluorescent tube immediately ignites again. Thus the tube current I takes the form of an almost sine wave, which flows throughout the entire half cycle.

According to the resistance ballast system, as shown in the graph of FIG. 2, the tube voltage Vd is in phase with the power voltage V. The instantaneous value of the power voltage V increases gradually until it reaches the tube voltage Vd which is necessary for the start of discharging the discharge tube, and at this stage (at the time $t_1$) it restrikes. The discharge ends at the end of the half cycle (the time $t_2$) when the instantaneous value in the power voltage V decreases and the tube current required to continue the discharging is lost. According to the resistance ballast system, the tube ignites between the time $t_1$ and $t_2$ in the half cycle of the power voltage V and there are short pauses before and after the above ignition period.

The fluorescent discharge tube of a kind having a relatively low voltage is designed to show the best characteristic thereof when the environmental temperature is between 20° C. and 25° C., and its characteristic deteriorate with a further rise or lowering of the temperature. In other words, at the higher or lower environmental temperature, the tube voltage of the igniting fluorescent discharge tube increases. The tube voltage increases not only at the time ignition starts but also while the discharge tube ignites, which is required for the restriking at each half cycle of the AC voltage, as shown in dotted lines in FIGS. 1 and 2. It is understood therefore that even with the igniting circuit using the choke stabilizer, restriking occurs with difficulty when the environmental temperature is above 40° C. or under 0° C. In such state, flickers are seen in the lighting condition of the tube. Since there are discharge pauses in the igniting circuit of the resistance ballast system, as already explained above, the restriking of the discharge tube does not occur until the instantaneous value reaches the increased tube voltage.

The above shows that pause time and flicker exist during the lighting time. This has been found by the inventor of this invention to be a vital disadvantage during lighting when the device does not have a kick voltage generator.

Using a 100 V commercial AC power source, 90% of the marketed circular fluorescent discharge tubes have a rating of around 30 W. This tube does not include any igniting means therewith. Because of the design of such discharge tubes, the tube current thereof is 0.62 A, which is abnormally high compared with that (0.375 A) of the 20 W discharge tube. The temperature of the tube wall during ignition is apt to rise, and as a result, the tube voltage, 58 V, is further raised. The effect of the environmental temperature is larger in the 30 W class than in the lower wattage, class which will be explained hereinunder.

When the preheating circuit is formed with a glow starter, the glow discharge start voltage of the starter, which is between 63 V and 94 V, is set higher than the ordinary tube voltage, 58 V. However due to the change of the environmental temperature, the tube voltage increases. When it increases to or above the glow discharge start voltage, the operation of the glow starter occurs again and the fluorescent discharge tube does not ignite. Particularly the stability of the ignition of a glow bulb is reduced according to the characteristic of the glow bulb itself or the change with the passage of time. This is disadvantageous when the usable environmental temperature range should be increased.

Even with the igniting circuit using the choke stabilizer, this occurs. But in such a case, this phenomenon is somewhat reduced with the above mentioned counter electromotive force generated by the stabilizer. Such a counter electromotive force is not generated in the igniting circuit of the resistance ballast system, and therefore this phenomenon is significant. Some solution is therefore required.

In order to solve this problem, it has been proposed to use a static semiconductor switching element, in place of the glow starter.

The circuit construction of the igniting circuit using this semiconductor switching element has been proposed to overcome the change of the glow starter with the passage of time. Particularly, it is designed to shorten the preheating time of the glow starter. An aim has been to make the quick starting type igniting system reliable. As the semiconductor element, a bi-directional diode thyristor as an SSS element, a reverse blocking triode thyristor as an SCR element or a TRIAC have been used.

The semiconductor switching elements used in the conventional lighting device are mainly for the opening and closing of the preheating circuit. In these conventional devices the discharge start voltage (kick voltage) has been obtained by the choke stabilizer or the counter electromotive force generator coil.

By the use of the choke stabilizer including an inductance series circuit, good ignition start and restriking operation may be obtained, and so the rise of the tube voltage is relatively small compared with the change of the environmental temperature. As a result, the circuit construction may be simple when using the semiconductor switching element. On the other hand, according to the resistance ballast method, the igniting start voltage and the restriking voltage of the 30 W FCL-30 type fluorescent discharge tube is, at the maximum, 80 V at normal temperature, 20° C., while it rises up to 120 V or so, when the environmental temperature is 0° C. The circuit structure of the semiconductor switching element circuit thus becomes complicated to compensate for the changing range of this tube voltage so as to assure proper operation at all times.

In fact, the highest break over voltage $V_B$ of the bi-directional diode thyristor (SSS element) is 120 V or so. An SSS element of higher voltage $V_B$ is not marketed at present. Thus the practical use of these semiconductor elements in the resistance ballast type igniting circuit is not an easy problem.

When the igniting circuit is constructed according to the resistance ballast system, the triode thyristors such as the SCR or TRIAC which are turned on by the gate current control may be used in practice.

According to the present invention, the igniting circuit of the preheating type fluorescent discharge tube is formed according to the resistance ballast system to reduce the weight of the entire device and to obtain other effects to be explained later. In this circuit, an induced pulse of a high frequency and a high voltage is applied to the outer wall of the discharge tube by the use of the glow starter, so that the starting mechanism may be simplified and produced at low cost. Also, a semiconductor switching element is used in the circuit with very good restriking operation for increasing the practical environmental temperature range.

In order to make the entire device compact, a circular shaped fluorescent discharge tube is preferable. The arrangement of the ballast incandescent bulb and the circular fluorescent discharge tube in the present fluorescent lighting device has most naturally been made, that is the disposition of the ballast incandescent bulb within the center circle of the circular discharge tube. A base or receiving mechanism, is mounted to a part of the above combination. This arrangement is advantageous for its compactness, good design of the device and a good light distribution characteristic.

It is therefore an object of this invention to provide the most effective lighting device, in production and usage, with a ballast incandescent bulb constituting an igniting circuit device and a circular fluorescent discharge tube.

It is a further object of this invention to provide a compact fluorescent lighting device.

In order to fulfil these objects, the fluorescent discharge tube includes an igniting circuit means and the receiving part in the inner center of a circular discharge tube. The main body of the device may be assembled in use and may be laid down with respect to the supporting post, shade or cover, so as to give a small circular shape to the entire device. The main body may further be detached from the remaining structure for easy transportation or maintenance.

The lighting device of this invention may be used for an electric stand to be placed on a desk or other place.

BRIEF DESCRIPTION OF THE DRAWINGS

The invention will further be understood by reference to the figures of the accompanying drawings in which like reference numerals represent like parts in so far as possible in the several figures. In the figures:

In FIG. 3 in which a circuit of an embodiment of the fluorescent lighting device of this invention is shown, both discharge electrodes (cathodes) 2*a* and 2*b* of a fluorescent discharge tube 1 are of the preheating type and are formed as filaments in which tungsten wires are wound, respectively.

Figure 1:
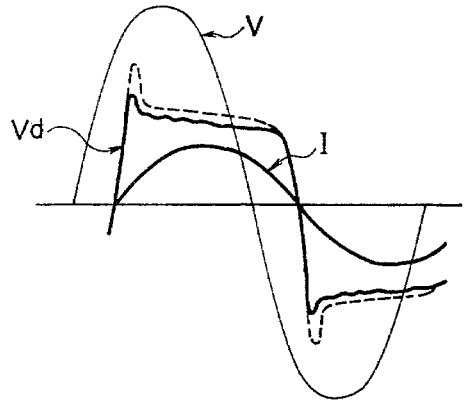
FIG. 1 is a graph of the ignition performance characteristic of the conventional preheating type fluorescent tube with an igniting circuit using a choke stabilizer.
Figure 2:
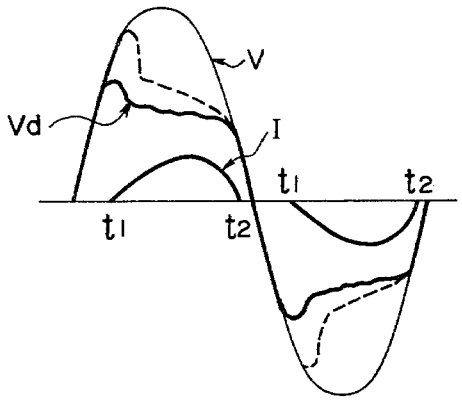
FIG. 2 is a graph of the ignition performance characteristic of the conventional preheating type fluorescent tube with an igniting circuit according to the resistance ballast system.

The respective discharge electrodes 2*a* and 2*b* are connected at one of the leads with a commercial alternating current power source through a switch 3 and an incandescent bulb 4. This incandescent bulb 4 is inserted in series with the respective electrodes as a resistance ballast.

The fluorescent discharge tube 1 is of the preheating type and of straight or circular shape, and the incandescent bulb 4 used may be chosen among easily available marketed bulbs. For example, when a 100 V AC power source is used, the combination would be: a 20 W fluorescent tube and a 60 W/100 V incandescent bulb; a 30 W fluorescent tube and 100 W/100 V incandescent bulb; or a 40 W fluorescent tube and two 60 W/100 V incandescent bulbs.

The other leads of the electrodes 2*a* and 2*b* are connected with a preheating circuit through a glow bulb 5. The glow bulb 5 is connected with a surge voltage absorbing circuit including a noise silencer capacitor 6 connected in parallel therewith in order to absorb a surge voltage generated in the glow bulb 5 at the time of opening and closing of the contacts. Capacitor 6 minimizes the electromagnetic noise generated by the bimetal glow bulb igniter 5 which reaches the environment surrounding the lighting device.

According to this invention, in the surge voltage absorbing circuit a primary coil 7*a* wound around a ferrite core 7*c* of a pulse transformer 7 is inserted and connected in series with the condenser 6 thereof. One end of a secondary coil 7*b* of the transformer 7 is connected with one end of the primary coil 7*a*, while the other end of the secondary coil 7*b* is connected with an auxiliary electrode 8 made of conductive material which is fitted to the outer wall of the fluorescent discharge tube 1.

When the power switch 3 is closed, a voltage is applied to the glow bulb 5 through the ballast incandescent bulb 4 and the filaments of the two discharge electrodes 2*a* and 2*b*. The glow bulb 5 starts a glow discharge between the electrodes. As the temperature within the glow bulb 5 rises due to this discharge, one of the bimetal electrodes bends to touch the other electrode, thus forming the preheating circuit. A preheating current then flows under the control of the incandescent bulb 4 into the filaments of the discharge electrodes 2*a* and 2*b*. The filaments are heated, and a thermoelectrons begin to be emitted from the electrodes 2*a* and 2*b*. The time chart thereof and the preheating current characteristic are shown in FIG. 4.

After a sufficient preheating time, the bimetal electrode is cooled and is disconnected from the opposing electrode. The separation of the glow bulb contacts causes, the preheating step end. When the bimetal electrode is separated, there arises a spark between the bimetal electrode and the other electrode.

Figure 4:
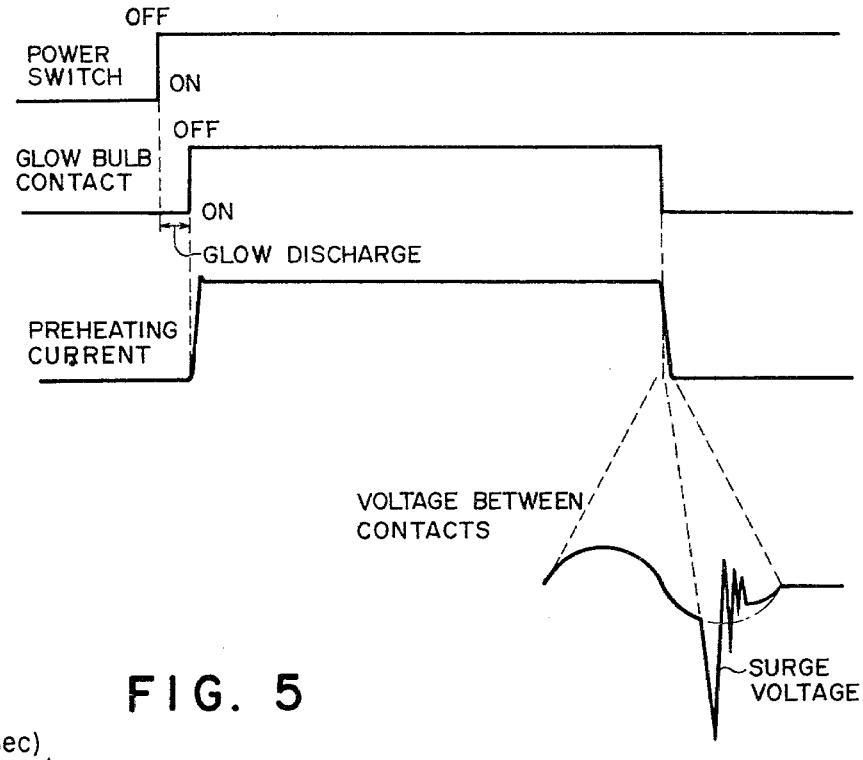
FIG. 4 is a time chart showing the operational condition of the fundamental ignition circuit shown in FIG. 3.

This spark generates a surge voltage between the electrodes of the glow bulb, as shown in FIG. 4 by the characteristic curve labeled "voltage between contacts".

The surge current flows into the absorbing circuit through the condenser 6 and acts on the primary coil 7*a* of the pulse transformer 7 inserted in series in the circuit. As the result, a transformer 7 receives in its primary coil 7*a* a surge voltage several or more times higher than the source voltage and generates in its secondary coil 7*b* a high voltage pulse of high frequency. This high voltage pulse is applied between the auxiliary electrode 8 and the discharge electrode 2*b*, and the thermoelectrons within the tube are thereby accelerated by the auxiliary electrode 8 and travel toward the other discharge electrode. Thus the discharge between electrodes starts.

The pulse transformer 7 receives at its primary side a high surge voltage of high frequency although the current flowing through the primary coil is rather small. Therefore a transformer with less stray capacitance but of high withstand voltage may be employed. Such a transformer has a small conductance at its primary coil. An example of the pulse transformer used in this invention is for the primary coil, an insulated wire of 0.25–0.29$\phi$, with 11–20 turns; for the secondary coil, an insulated wire of 0.06$\phi$, with 400–500 turns; the coils are wound around a single ferrite bar core into a honeycomb coil of an outer length 8.5–16 mm, and 8 mm or so, in diameter; and the weight of the transformer is more than ten grams. In the circuit of the embodiment shown in FIG. 3, using the pulse transformer above defined with 100 V commercial AC power, the voltage appearing in the secondary coil of the pulse transformer is a damped oscillation wave of 0.27–0.5 $\mu$sec. in width, the maximum wave height 5 KV, and its duration of oscillation about 20 $\mu$sec. (with 60% damping).

Figure 3:
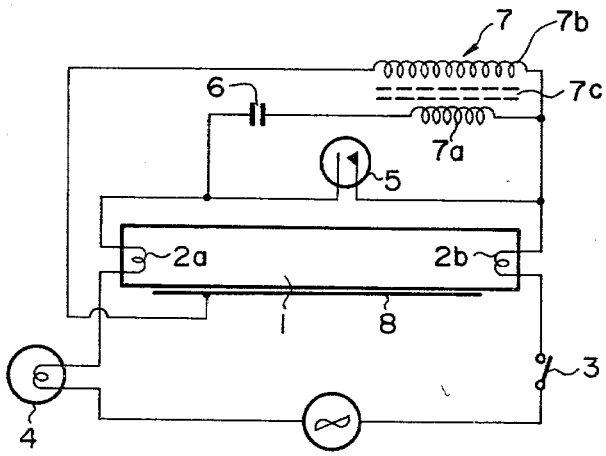
FIG. 3 is a circuit diagram of an embodiment of the fundamental igniting circuit for the fluorescent lighting device according to the present invention.
Figure 5:
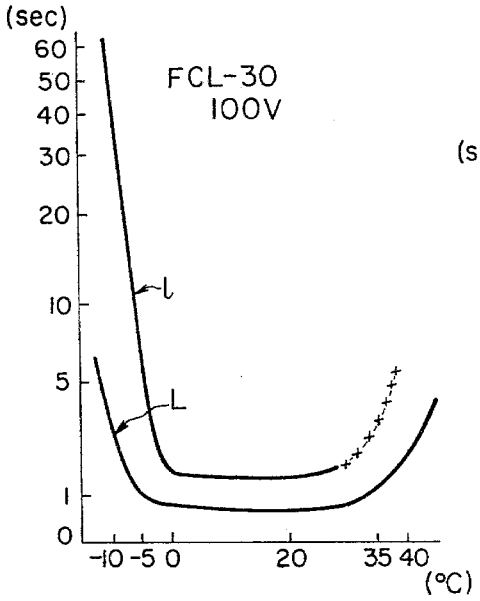
FIG. 5 and FIG. 6 are graphs comparing the ignition characteristic in the circuit of FIG. 3.

FIG. 5 is a graph of a lighting test for the embodiment of FIG. 3, in which the 100 V power source, a 30 W fluorescent tube (FCL30) and a 100 W/100 V ballast incandescent bulb are used. In the graph the axis of abscissa represents the environmental temperature (°C.) and that of ordinates the time duration (sec.) from the instant at which the power source switch is turned ON to the start of the discharge between the electrodes of the fluorescent discharge tube. The curve 1 represents the characteristic of a circuit device in which the line voltage is directly applied to the auxiliary electrode, and the curve L shows the characteristic of this invention. In the characteristic of the circuit device shown by the curve 1, the region shown in a broken line beyond the environmental temperature of 28° C. represents the region incapable of ignition just after the fluorescent tube has been lit for a long period of time.

Figure 6:
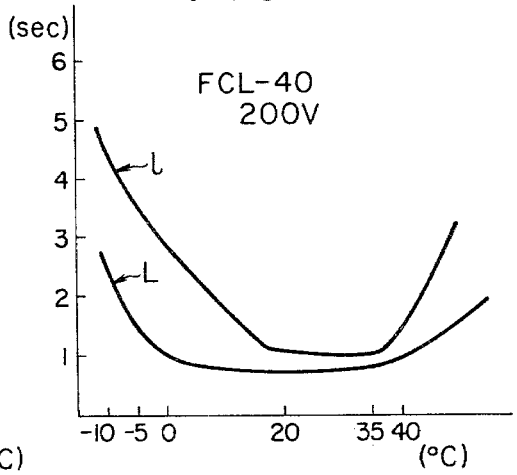

FIG. 6 is a graph similar to FIG. 5, but in this case a 200 V power source, a 40 W fluorescent tube (FCL40) and two 60 W/100 V incandescent bulbs are used, which are connected in series with each other.

As is apparent from the test results of FIGS. 5 and 6, the fluorescent lighting device according to this invention shows a significant effect particularly when it is used at a low environmental temperature. This is because it uses a pulse transformer utilizing the surge voltage generated by the glow bulb. It can ignite at the normal temperature instantaneously within one second of the preheating time, which matches the operation of so-called quick ignition devices. At the higher temperature, reignition is assured even with a lower voltage tube of 30 W/100 V or so. When a higher voltage fluorescent tube of 40 W/200 V is used, the preheating time may be shortened at all environmental temperature ranges. Thus any undesirable waste of the emission material of the discharge electrodes of the fluorescent discharge tube due to the excess preheating may be avoided and the life of the tube itself is increased. Aside from the life of the tube, the lighting device of this invention may be utilized fluorescent discharge tubes other than the preheating type.

In another embodiment of this invention shown in FIG. 7, the same components as those of FIG. 3 are used but with some different connections between them, which will be explained with the same reference numerals.

Figure 7:
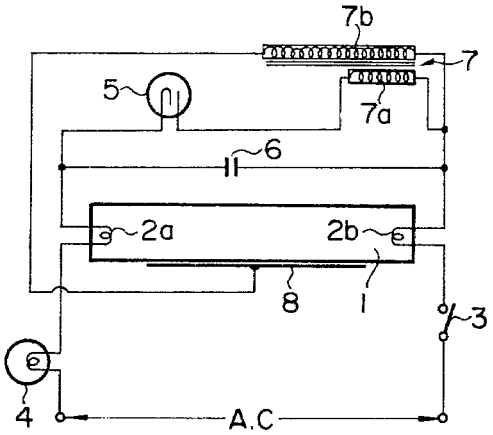
FIGS. 7 through 16 are circuit diagrams showing other embodiments of an ignition circuits according to this invention based on the circuit of FIG. 3.

In the circuit of FIG. 7, the preheating current circuit is formed as follows: While one of the leads of each cathodes 2*a* and 2*b* of the fluorescent discharge tube 1 is connected with the power circuit through a switch 3 and an incandescent bulb 4, the other lead of each of the electrodes wound with tungsten wire is connected with the series circuit of the glow bulb 5 which acts as a preheating switch and the primary coil 7*a* of the pulse transformer 7 and further the noise silencer condenser 6 is connected in parallel with the series circuit. The condenser 6 absorbs the surge voltage generated at the time of opening and closing of the contacts of the glow bulb 5. Other circuit structure of the circuit is the same as that of the circuit of FIG. 3.

When the power switch 3 is closed or turned ON, the voltage is applied to the glow bulb 5 through the ballast incandescent bulb 4, the filaments of the two cathodes 2*a* and 2*b* and the primary coil 7*a* of the pulse transformer 7, the glow bulb 5 then starting the glow discharge between the electrodes of the glow bulb. By the rise of temperature within the glow bulb 5 due to the above glow discharge, one of the electrodes, which is a bimetal electrode, bends and touches the other electrode to form the preheating circuit therewith. The preheating current thereby flows, under the control of the ballast incandescent bulb 4, into the filaments of the electrodes 2*a* and 2*b* of the fluorescent discharge tube. After the filament is warmed, thermoelectrons begin to be discharged from the electrodes 2*a* and 2*b* of the fluorescent discharge tube 1.

After sufficient preheating time has passed, the temperature of the bimetal electrode of the glow bulb 5 is decreased causing the electrodes to separate, and by this opening of the contacts the preheating operation ends. When the contacts are opened, a spark occurs between the retreating bimetal electrode and its opposing electrode. By this spark, a surge voltage is generated between the electrodes of the glow bulb 5.

The above preheating current flows through the primary coil 7*a* of the pulse transformer 7, and thus during the preheating time duration a certain boosting voltage of the period according to the frequency of the line AC voltage is generated. This voltage is applied to the auxiliary electrode 8 but the voltage is not sufficiently high to ignite the fluorescent discharge tube 1. At the completion of the preheating operation a surge voltage is generated in the preheating circuit and the surge current flows into the condenser 6. The surge current flows through the above primary coil 7*a* thereby generating high voltage pulses at the secondary coil 7*b* of the transformer 7. In other words, this surge voltage is of high frequency and high voltage due to the pulsive discharge current between the electrodes during the opening movement of the glow bulb electrodes. This voltage is applied to the primary coil 7*a* of the pulse transformer 7. The output of the secondary coil 7*b* is now of high frequency and higher voltage pulse.

This secondary high voltage pulse is applied between the auxiliary electrode 8 and the cathode 2*b*. The thermoelectrons within the fluorescent tube 1 are now accelerated by the auxiliary electrode 8 and travel to the other cathode 2*a*. Thus the start of lighting, namely the discharge between the electrodes of the fluorescent discharge tube begins.

The characteristic of the embodiment of FIG. 7 is as good as that of FIG. 3, in the circuit of FIG. 3 the primary coil 7*a* of the pulse transformer 7 being connected together with the surge voltage absorbing condenser 6 in parallel with the switch of the glow bulb 5, etc. Particularly, in the embodiment of FIG. 7, the primary coil 7*a* of the pulse transformer 7 is inserted in series in the preheating current circuit, so that the boosting voltage of the AC voltage is generated at the secondary coil 7*b* during the preheating operation. This boosting voltage is applied to the auxiliary electrode 8, and it is not sufficient to ignite the fluorescent discharge tube 1. However, this voltage has some influence on the thermoelectrons in the discharge tube 1. This influence is therefore effective for the ignition operation of the fluorescent discharge tube 1 at the end of the preheating operation. The pulse transformer 7 is operated by the high frequency pulsive current at the end of the preheating operation. Thus the condenser 6, which is of a small capacity, may be used mainly for utilizing its noise silencing function. Also, the flow of the current to the primary coil 7*a* rapidly decreases after the ignition of the fluorescent discharge tube 1. Thereafter high voltage is not generated in the secondary coil 7*b*. Thus the high voltage is generated for a very short time so that electric shock when one touches the auxiliary electrode 8 can be avoided.

Figure 8:
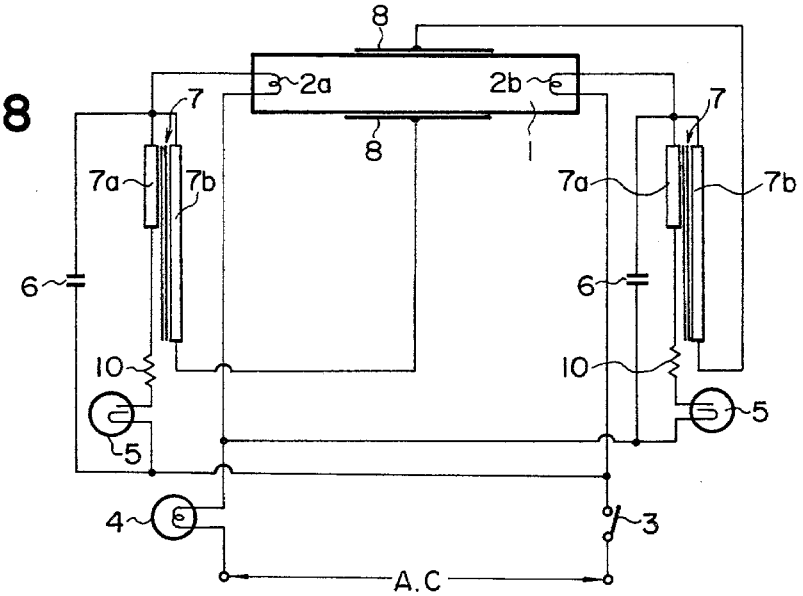

On the other hand, in the circuit of FIG. 8 showing another embodiment of the fluorescent lighting device of this invention, an independent preheating current circuit is formed for each of the two cathodes 2*a* and 2*b* of the fluorescent discharge tube 1, and in each of these preheating circuits, the circuit components of the glow bulb 5, the pulse transformer 7 and the condenser 6 are included. The respective secondary coils 7*b* of the pulse transformers 7 are connected with the respective auxiliary electrodes 8, 8 provided at the outer wall of the fluorescent discharge tube 1. Further, resistors 10, 10 are inserted in series in the preheating current circuit for regulating the preheating current.

By the closure of the power switch, the preheating current of the circuit flows into the cathodes 2*a* and 2*b*, each being independent from the other, through an incandescent bulb 4 when the respective glow bulbs 5, 5 close. After lapse of a certain time, the glow bulbs 5, 5 open and the ignition begins just the same as the embodiment of FIG. 7. In this connection, it has been understood that even the same type of glow bulbs are used for controlling the opening and closure of both preheating circuits, their characteristics, particularly their contact opening time, being always slightly different from each other. Thus the complete synchronization of the end of the period of the preheating circuits is impossible. By the operation of the pulse transformer 7 in the preheating circuit of the firstly opening glow bulb 5 among the two bulbs 5, 5, the fluorescent discharge tube 1 ignites and discharges and when the other preheating circuit then opens, the ordinary lighting condition is obtained. Since this time lag is only of a very short duration, such may be ignored in practical use. If however the synchronization is by all means desired, one of the glow bulbs 5 may be substituted with a reed relay switch so as to apply the preheating current of the other glow bulb or a part of it to the actuating coil of the reed relay. In the present embodiment, the outputs of both secondary coils 7*b* of the transformers may be connected with one of the auxiliary electrodes 8.

Figure 9:
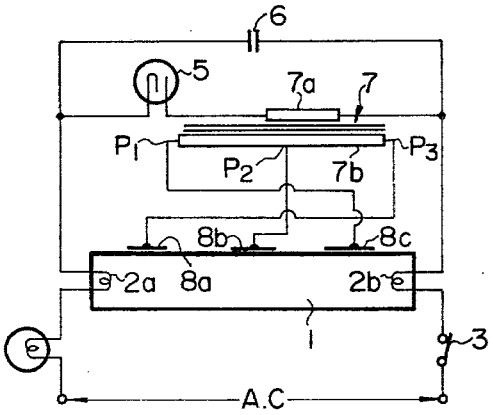

In the circuit of FIG. 9 showing a further embodiment of this invention, the same components as those of the FIG. 7 circuit are represented with the same reference numerals. In the circuit of FIG. 9, there is provided an intermediate tap terminal $P_2$ other than the output terminals $P_1$ and $P_3$ of the secondary coil 7*b* of the pulse transformer 7 and these terminals $P_1$, $P_2$ and $P_3$ are respectively connected with three auxiliary electrodes 8*a*, 8*b* and 8*c* provided by the outer wall of the fluorescent discharge tube 1. When the connection is made, the output terminal $P_1$ is connected with the auxiliary electrode 8*c* disposed in the vicinity of the cathode 2*b*; while the auxiliary electrode 8*b* is connected with the tap terminal $P_2$; and the auxiliary electrode 8*a* is connected with the remaining output terminal $P_3$.

The preheating operation and the subsequent high voltage pulse generating operation at the secondary coil 7*b* of the pulse transformer 7 at the end of the preheating operation are the same as those of the embodiment of FIG. 7. However, since the voltage generated at each of the terminals $P_1$, $P_2$ and $P_3$ of the secondary coil 7*b* of the pulse transformer 7 is applied according to this embodiment to the cathodes 2*a* and 2*b* in such a manner that the respectively different voltages are applied successively. Therefore the movement of the thermoelectrons caused by the applied voltage to the auxiliary electrodes 8*a*, 8*b* and 8*c* is effectively made and good igniting operation of the fluorescent discharge tube 1 may be obtained.

In the circuits of other embodiments of this invention shown in FIGS. 10 through 13, the high voltage pulse generated in the secondary coil 7*b* of the pulse transformer 7 is applied into the fluorescent tube 1 through the different connecting lines between the circuit elements.

Figure 10:
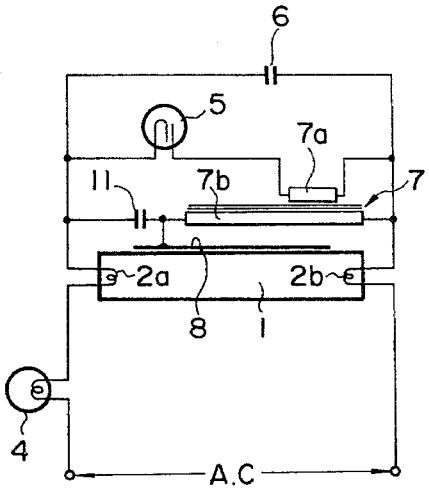

In the embodiment shown in FIG. 10, the output terminals of the secondary coil 7*b* are connected between the cathodes 2*a* and 2*b* through a condenser 11 which is used for regulating the flowing current. When the preheating operation ends, the high voltage pulse generated in the secondary coil 7*b* is directly applied to the cathodes 2*a* and 2*b* and also to the auxiliary electrode 8, thus obtaining a sure igniting operation.

Figure 11:
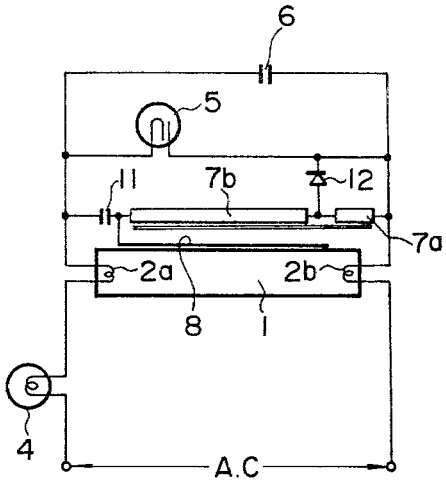

In the embodiment shown in FIG. 11, one of the terminals of the secondary coil 7*b* is connected with the connection side of the primary coil 7*a* and the glow bulb 5, and between the connection wire of its connecting point and the glow bulb 5 is inserted in series a diode 12 which prevents loss of the secondary high voltage pulse through the glow bulb 5. Thus, a similar effect is obtained as with the circuit of FIG. 10.

Figure 12:
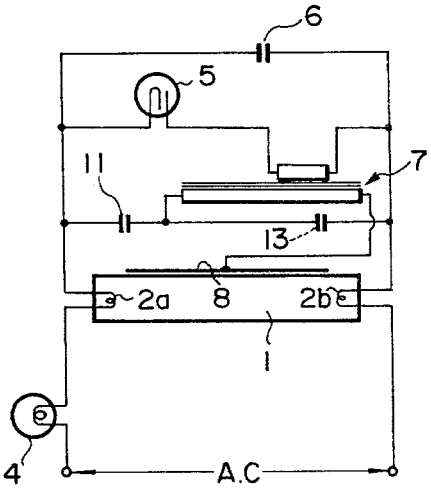
Figure 13:
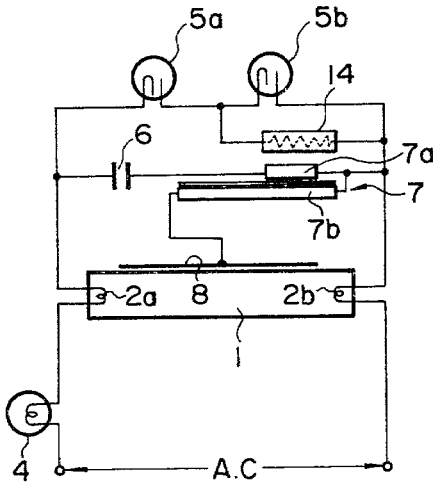

In order to solve the problem of the polarity of the high voltage pulse applied to the auxiliary electrode 8 with respect to the cathodes 2*a* and 2*b*, the embodiment of FIG. 12 is useful. In the embodiment of FIG. 12, one electrode of the secondary coil 7*b* of the pulse transformer 7 is connected with the cathodes 2*a* and 2*b* of the fluorescent discharge tube 1 respectively through current regulating condensers 11 and 13, while the other electrode of the secondary coil 7*b* is connected with the auxiliary electrode 8. The embodiment of FIG. 13 is valuable in its performance characteristic at a low temperature range when the glow starter is used. In other words, as has been already explained heretofore, in the fluorescent discharge tube 1 of this kind, the repetitive discharge voltage (=tube voltage) is raised at a low temperature, lower than 5° C., of the environmental temperature and as the result, the repetitive operation phenomenon of the glow starter occurs.

In order to deal with this phenomenon, the use of the semiconductor starter is the most advantageous, as will be explained later. But the problem may be solved by inserting the two glow bulbs 5*a* and 5*b* in series with each other. To each of the glow bulbs thus connected in series, 50% of the line voltage (voltage between terminals) is applied, and so the glow bulbs do not operate because they are set to operate with about 70% of the line voltage. For the solution thereof a current and voltage control element 14, for example a resistor, a condenser or the combination of these is inserted in parallel with either of the serially connected glow bulbs 5*a* and 5*b*, for example 5*b*. By this element 14, the voltage between the terminals of the glow bulb 5*b* is reduced, while that of the glow bulb 5*a* rises. The current voltage control value of the element 14 is set to operate to apply its operating voltage to the bulb 5*a*, where the voltage between its terminals rises, when the AC line voltage reaches around its peak. By the closure of a power switch at the time of the igniting operation of the fluorescent discharge tube, voltage is applied to the glow bulb 5*a* through the element 14 and the bulb 5*a* starts its discharge. The discharge lasts only a short time while the AC line voltage is around its peak, and about one-fourth second elapses up to the closure of the bimetal contact of the bulb 5*a* from the closure of the power switch, which is only slightly longer than the ordinary case. By the closure of the contact of the glow bulb 5*a*, the remaining bulb 5*b* is in an ordinary state, so that the known preheating operation of the fluorescent tube may be made subsequently under the closure of the contacts of the glow bulbs 5*a* and 5*b*. By the opening or return of the contacts of the glow bulb 5*a* which has been earlier in closure of contact than the other, the preheating operation ends. The fluorescent tube 1 then is ignited by the operation of the pulse transformer 7 like other embodiments already explained.

On the other hand, even when the tube voltage of the tube 1 is high, since the glow bulb 5*a* is set to operate only by the higher line voltage controlled with the element 14, the fluorescent discharge tube 1 reignites before the supplied AC line voltage reaches the voltage that can operate the glow bulb 5*a*. Thus the repetitive operation of the glow bulb may be avoided.

Although not shown in the figures, many variations of the circuit arrangement may be made in the already explained circuits of the embodiments by changing the combination of the circuit elements. Particularly, the application of a high voltage generated in the secondary coil 7*b* into the fluorescent discharge tube 1 may be utilized in the embodiment of FIG. 3.

Figure 14:
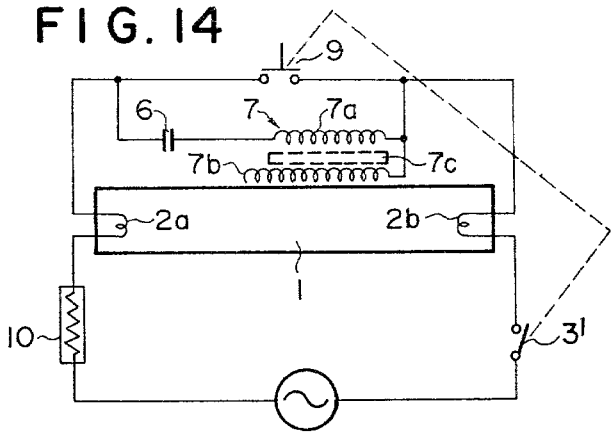

FIG. 14 shows another embodiment of the present invention. As shown, a push button switch 9 of manual use may be used in place of the glow bulb 5 of the embodiment of FIG. 3. In this circuit, a rotary switch structure is used for a power switch 3' associated with the switch 9. For the incandescent bulb 4 of FIG. 3, a resistance wire 10 is used. In the embodiment of this circuit it should be particularly noted that the auxiliary electrode 8 is not used, and in place thereof the pulse transformer 7 is directly disposed in the vicinity of a part of the outer wall of the fluorescent tube 1.

In the embodiment of this FIG. 14, the preheating operation starts with the pushing down and closure of the push button switch 9 and the ignition is easily made by the opening of the switch 9 by hand when the local discharge is seen in the electrodes 2*a* and 2*b* of the fluorescent tube 1.

It should be noted that by replacing the glow bulb 5 with the push button switch 9; the pulse transformer 7 with the auxiliary electrode 8; or the incandescent bulb 4 with the resistance wire 10 in the circuits the same effect may be obtained for the purpose of this invention.

Figure 15:
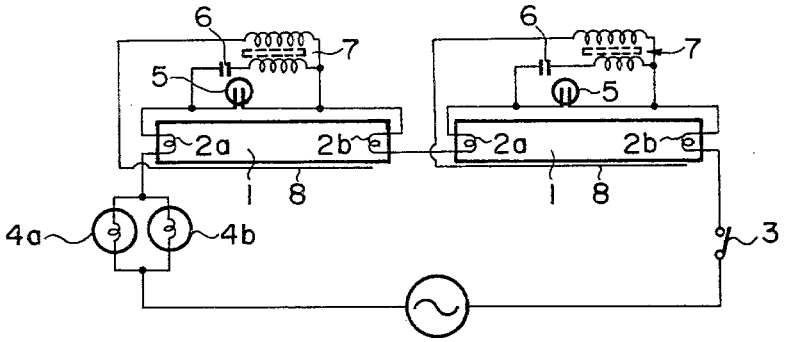

In FIG. 15, circuit arrangements particularly effective for a lower voltage fluorescent tube, of less than 30 W is used under a high voltage, for example of 200 V, power source area. In the shown embodiment, a pair of the fluorescent tube (each of less than 30 W) are used each including the preheating circuit and the starter auxiliary circuit shown in FIG. 3. These fluorescent discharge tubes are combined so as to connect the respective discharge electrodes 2*a* and 2*b* in series with each other. As the ballast, a pair of incandescent bulbs 4*a* and 4*b* respectively matching with the fluorescent discharge tubes 1 are inserted in the circuit so as to be in parallel with each other. In this case, the incandescent bulbs must be for 200 V use.

In order to ignite a fluorescent discharge tube of less than 30 W class designed to be used under 100 V power under the 200 V commercial power source, a transformer for reducing the voltage has been used which acts also as a stabilizer. The voltage applied to the tube is therefore regulated to 100 V. However, the transformer used for this purpose is a large one and expensive, which results in the provision of a large and expensive final product.

When this is constructed according to the resistance ballast method, it is also necessary to give the resistance twice that under the 100 V power source, for example in the case of the incandescent bulb, parallel connection of two bulbs for 200 V power use. In other words, when using two fluorescent tubes, four times the number of ballast parts of as are used with 100 V power, are necessary which apparently requires further considerable cost. Also more parts must be used, which results in difficulties in assembling.

On the other hand, in the embodiment of FIG. 15, the two incandescent bulbs 4*a* and 4*b* for the ballast may only be used, which solves the problem of the cost and assembling. As above mentioned, each of the fluorescent discharge tubes 1 is provided with the pulse transformer 7 and the auxiliary electrode 8, and so good igniting operation as explained in the embodiment of FIG. 3 is assured under the normal as well as high or low temperature. The circuit elements or arrangements of this embodiment may be replaced with those of the circuit of FIG. 14.

Figure 16:
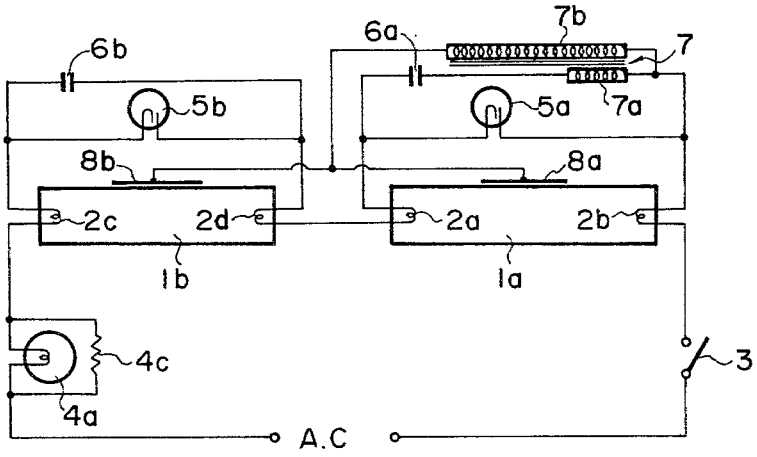

The circuit of FIG. 16 is a further improved embodiment of FIG. 15. In this embodiment, the filament cathodes 2*a*, 2*b*, 2*c* and 2*d* of the first and second discharge tubes 1*a* and 1*b* are connected in that order and in series. A power circuit is connected in series with one of the leads of the cathodes 2*c* and 2*b*. In this power supply circuit there is inserted in series an incandescent bulb 4*a* for the resistance ballast. With the ballast incandescent bulb 4*a* a resistor 4*c* is connected in parallel therewith, the resistor 4*c* being for regulating the circuit current. The resistor 4*c* is used for adjustment of the resistance when a commercially sold incandescent bulb is used, and therefore it may be omitted in the case of a specially designed electric bulb having a resistance to limit the necessary circuit current of the circuit device, or if the other pure resistor element is already used.

In the preheating current circuit including the filament cathodes 2*a*, 2*b*, 2*c* and 2*d* connected in series, a glow starter 5*a* is inserted between the cathodes 2*a* and 2*b* in series therewith, and a glow starter 5*b* is inserted between the cathodes 2*c* and 2*d* in series. The glow starter 5*b* is connected in parallel, with a noise silencing condenser 6*b*, while the other glow starter 5*a* is in parallel connected with a series circuit of a noise silencing condenser 6*a* and the primary coil 7*a* of a pulse transformer 7. In this case the glow starter may be replaced with a semiconductor switching element such as a SCR or SSS element.

One end of the secondary coil 7*b* of the pulse transformer 7 is connected with one end of the primary coil 7*a*, while the other end of the secondary coil 7*b* is connected with the auxiliary electrodes 8*a* and 8*b* which are fitted on or closely disposed by the outer walls of the fluorescent tubes 1*a* and 1*b*, respectively.

In the embodiment of FIG. 16, the fluorescent discharge tube 1*b* is of a FCL-22 W type, its rated voltage being 100 V and tube current being 0.39 A. The discharge tube 1*a* used is a FCL-32 W type, whose rated voltage is 147 V and tube current is 0.435 A. The power voltage supplied is between 220 V and 240 V. Other combinations are possible, for example, by using two FCL-22 W type tubes for the tubes 1*a* and 1*b*. Or, two FCL-30 W type tubes can be used for the tubes 1*a* and 1*b*. In other words, any types of tubes may be used if the tube current of the respective tubes 1*a* and 1*b* are almost equal to one another and the sum of the rated voltages is almost equal to the line voltage.

According to this embodiment, when a power source switch is tuned ON in the circuit device of FIG. 16, the glow bulbs 5*a* and 5*b* of the preheating circuits of the tubes 1*a* and 1*b* starts to discharge between the electrodes of the fluorescent discharge tube through the ballast element such as the incandescent bulb 4*a*, etc. By the heat thereby generated, the electrodes of the glow bulbs 5*a* and 5*b* contact and are closed. The preheating current now flows into the preheating circuits through the series connection so as to heat the filament cathodes 2*a*, 2*b*, and 2*c*, 2*d* of the discharge tubes 1*a* and 1*b*, respectively.

Although a high voltage power is supplied, the preheating operation is made with the even voltage supplied condition in both tubes 1*a* and 1*b* of the low voltage type by the aid of the ballast incandescent bulb 4*a*.

As the preheating operation is near its end, the glow bulb 5*b*, which has a low rated voltage opens before the other bulb 5*a* and the discharge tube 1*b* of the lower rated voltage moves from its discharge between the electrodes condition into the lighting condition. The other fluorescent discharge tube 1*a* receives, after the glow bulb 5*a* is closed, the tube current of the fluorescent discharge tube 1*b* already lit and at this stage the tube 1*a* is still under its preheating operation.

When the glow bulb 5*a* of the discharge tube 1*a* of the higher rated voltage opens, the preheating circuit is interrupted. The tube current of the discharge tube 1*b* is also interrupted and the tube 1*b* is turned off for a while. In this state the tube voltage based on the line voltage is applied to the discharge tubes 1*a* and 1*b*. By the opening of the glow bulb 5*a*, a surge current suddenly flows through the noise silencing condenser 6*a*, which is applied to the primary coil 7*a* of the pulse transformer 7. A high voltage generated in the secondary coil 7*b* of the transformer 7 is applied to the auxiliary electrodes 8*a* and 8*b* of the fluorescent discharge tubes 1*a* and 1*b*, which ignite synchronously by the thermoelectron energizing operation with the high voltage pulse.

If however the synchronous ignition of the tubes 1*a* and 1*b* does not occur by the one opening operation of the glow bulb 5*a*, which opens after a long preheating time, the glow bulb 5*a* at once closes because of the heat generated by the discharge. The fluorescent tube 1*b* thus ignites, while the tube 1*b* is in its preheating condition. The tube 1*a* repeats the operation of the changing into the synchronous igniting operation within a very limited time, and the fluorescent tubes 1*a* and 1*b* ignite stably thereby.

Figure 17:
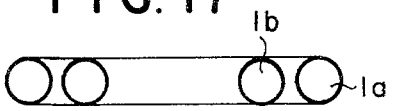
FIGS. 17 through 19 are views in section showing examples of the arrangement of two fluorescent discharge tubes according to this invention.
Figure 18:
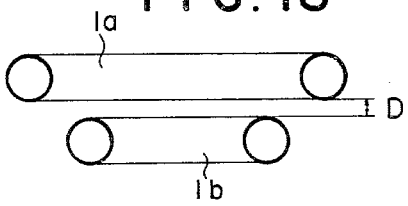
Figure 19:
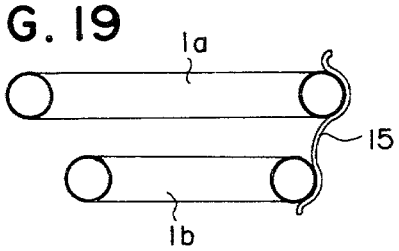

The two fluorescent discharge tubes 1*a* and 1*b* of the embodiment of FIG. 16 may be disposed as in FIGS. 17, 18 and 19. In FIG. 17, the two tubes are different in the diameter. They are disposed in the same plane. In FIG. 18, they are closely disposed, the distance D therebetween being within 30 mm. In this case (FIG. 18), a single auxiliary electrode may be disposed only on the fluorescent discharge tube 1*a* of the higher rated voltage. This electrode receives a high voltage pulse from the secondary coil 7*b* of the pulse transformer 7 and it or the tube 1*a* itself acts as the auxiliary electrode of the other fluorescent discharge tube 1*b*. The auxiliary electrode 8*b* for the fluorescent discharge tube 1*b* may thus be dispensed with. When the tubes are disposed apart from one another as shown in FIG. 19, the auxiliary electrodes 8*a* and 8*b* are equipped for the respective fluorescent discharge tubes 1*a* and 1*b*. The two auxiliary electrodes 8*a* and 8*b* may be supported with a single metal tube holder 12.

Figure 20:
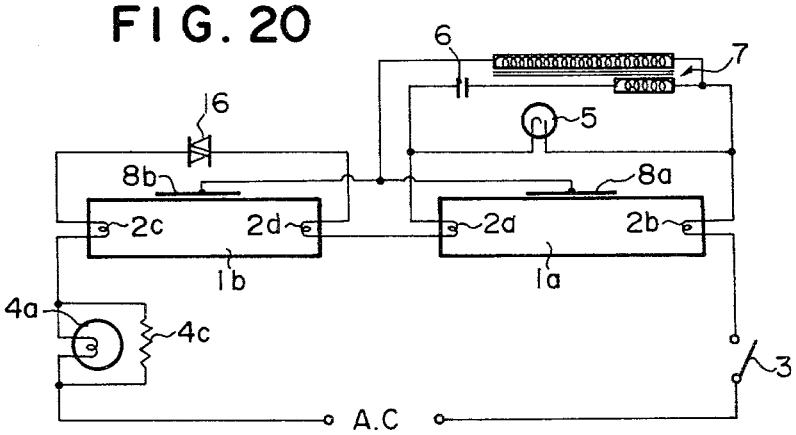
FIG. 20 is a circuit diagram showing another embodiment of the igniting circuit for the two-tube type lighting device.

In the circuit of FIG. 20, which is similar to that of FIG. 16, the starter of the preheating circuit for the fluorescent discharge tube 1*b* is a semiconductor switching element, that is an SSS element 16. The break over voltage of the element 16 must be higher than the firing voltage of the fluorescent discharge tube 1*b* and further than the discharge voltage of the glow bulb 5 of the other preheating circuit. When the switch 3 is turned ON, a series circuit of the primary coil of the pulse transformer 7, electrodes 2*a*, 2*d*, the element 16 and the electrode 2*c* is formed. Thus the line voltage is applied to the element 16. The SSS element 16 therefore repeats its ON and OFF alternately at every half period of the AC power voltage, while the discharge tube 1*b* receives a power voltage at its cathodes 2*c* and 2*d* during the OFF time of the element 16 until the discharge tube 1*b* reaches the firing voltage. When the fluorescent tube 1*b* reaches the firing voltage which is lower than the break-over voltage of the SSS element, it ignites after a sufficient discharge of thermoelectrons by the preheating operation. In the fluorescent discharge tube 1*b*, the preheating operation and the tube voltage applying operation occur alternately at every half period of the AC power source, and its firing occurs at an early stage in the preheating time during which the discharge of the thermoelectrons necessary for the discharge between the electrodes takes place. On the other hand, in the other preheating circuit of the other discharge tube 1*a*, the glow bulb 5*a* opens after the lapse of a predetermined time according to the time constant. The fluorescent discharge tube 1*b* is thus early in its lighting and moreover when a tube 1*b* of the low rated voltage is used, this fluorescent tube 1*b* not only shows an earlier lighting than the other discharge tube 1*a*, but also the follow-up synchronization of the tube 1*b* in the lighting operation is possible with the other tube 1*a* as in the FIG. 16 embodiment.

Particularly, the embodiment of FIG. 20 is useful when similar tubes 1*a* and 1*b* are used in which the igniting operation is easily made. By setting the break-over voltage of the SSS element 16 higher than the glow discharge voltage of the glow bulb 5*a*, the discharge tube 1*b* may receive a sufficient discharge start voltage at every half period of the AC source voltage for a relatively long time. It is therefore useful for making the earlier igniting operation certain.

The primary coil 7*a* of the pulse transformer 7 may be inserted in series into the preheating current circuit or alternately, semiconductor switching elements may be used for the starters of the preheating circuits.

As explained above, according to the embodiments of FIGS. 16 and 20, the fluorescent lighting device of this invention is constructed with the two series fluorescent tubes but without the power transformer and the choke stabilizer. Its load is low and the various outer design is thought out. Its lighting characteristic with regard to the effectiveness and efficiency of energy is still better, compared with an incandescent bulb or a parallel lighting device which uses a stabilizer as shown in the Table:

| | power voltage (V) | input current (A) | input voltage (W) | apparent power (VA) | all flux of light (l) | 1/W | 1/VA |
|---|---|---|---|---|---|---|---|
| this invention (32W + 22W) | 220 | 0.40 | 84 | 88 | 3450 | 41.0 | 39.2 |
| incandescent bulb (100W) | 220 | 0.45 | 100 | 100 | 1300 | 13 | 13 |
| lighting device with stabilizer (32W + 20W) | 200 | 0.805 | 73 | 161 | 3310 | 45.3 | 20.5 |

As shown above, the fluorescent lighting device of this invention is in effectiveness 1/W or 1/VA (apparent power ratio) thrice as much as the incandescent bulb and 1.9 times as much as the parallel lighting device with the stabilizer.

In the embodiments heretofore mentioned a glow bulb is used as a starter for the preheating circuit. By the opening and closing thereof control of the preheating operation is obtained and also high voltage generating operation is obtained by the pulse transformer.

Explanation is now made of some embodiments of this invention wherein a semiconductor starter is used. The semiconductor starter may be applicable throughout the wide range of the environmental temperature.

Figure 21:
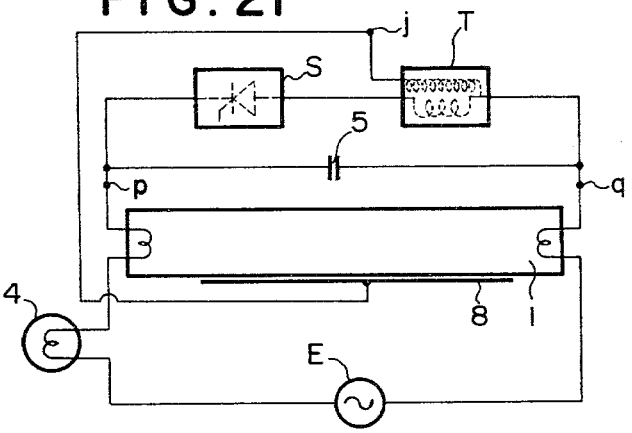
FIG. 21 is a circuit diagram showing a fundamental embodiment of the igniting circuit using a thyristor starter according to the present invention.

The circuit shown in FIG. 21 includes a semiconductor starter, in which an incandescent bulb 4 is inserted in series as a resistance ballast in the power supplying circuit from the AC power source E to the preheating type fluorescent discharge tube 1. In the preheating circuit connecting the other leads of the power connecting side of the filament electrodes of the fluorescent tube 1, there are connected in series with each other a starter S comprising a semiconductor element and its turn-on control circuit and a primary coil with more than ten turns of the pulse transformer T to be compared with the pulse transformer 7 used in the foregoing embodiments. The secondary coil of the pulse transformer T, which has several hundreds turns is connected at its one end with one end of the primary coil, while the other end of the secondary coil is connected with an auxiliary electrode 8 fittingly or closely disposed to the outer wall of the fluorescent discharge tube 1. In this circuit, condenser 5 silences noises and the discharge current flows to the pulse transformer T.

When the AC power is supplied into the circuit and the instantaneous value of the first half cycle of the AC current reaches a sufficient value to turn on the semiconductor switching element of the starter S, the starter S turns ON. By the turning on of the starter S, a relatively large preheating current of about 1.5 times the tube current during lighting flows into the filament electrodes of the fluorescent discharge tube 1 under the control of the incandescent bulb 4 included in the circuit. This operation is repeated at each subsequent cycle and the filament electrodes are heated accordingly. In case a one-way switching element is used, the operation repeats at every half cycle.

Figure 22:
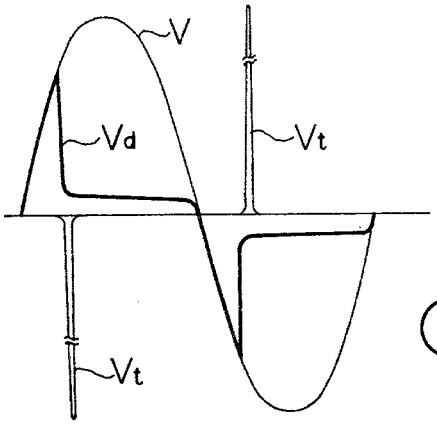
FIG. 22 is a graph showing the performance characteristic of the circuit shown in FIG. 21.

During the preheating operation of the fluorescent discharge tube 1, the condenser 5 is charged at the beginning of each cycle of the AC voltage and the current is discharged when the starter S turns ON. The preheating current and the discharge current of the condenser 5 by the turning ON of the starter S flow through the primary coil of the pulse transformer T inserted in series in the preheating circuit. As a result, there appears in the secondary coil of the pulse transformer T a high voltage according to a pulsewise primary current with high variable rate by the condenser discharge current. This state is shown in FIG. 22, in which V indicates a power voltage; Vd a tube voltage; and Vt a high voltage generated in the secondary coil of the pulse transformer T.

The high voltage Vt is applied to the outer wall of the fluorescent discharge tube 1 through the auxiliary electrode 8. Its effect is not seen in the initial stage (at several tens of cycles) of the preheating operation when the filament electrodes of the fluorescent discharge tube 1 are not so sufficiently heated. But as the preheating operation proceeds and as the filament electrodes are sufficiently preheated so as to provide good discharge of the thermoelectrons from the electrodes, the thermoelectrons are accelerated and move by the auxiliary electrode 8 which is supplied with the high voltage. The glow discharge now starts between the filament electrodes and the tube wall to which the auxiliary electrode 8 is closely disposed.

At the time of generation of the high voltage pulse Vt in the half cycle of the AC power voltage, the starter S is in the ON state and the tube voltage Vd is low. Thus the main discharge lighting does not yet occur between the filament electrodes after the glow discharge between the filament electrodes and the outer wall to which the auxiliary electrode 8 is closely disposed. In the next half cycle, while the starter S is not in the ON state, the ON operation of the starter S being set in its response voltage to a higher voltage than the lighting start voltage of the fluorescent discharge tube 1, the instantaneous value of the AC power voltage reaches the lighting start voltage before it reaches the response voltage. The flow discharge occurs with the high voltage at the half cycle. By this, the main discharge lighting begins to proceed between the filament electrodes with the ionized electrons remaining within the inner wall of the fluorescent discharge tube 1 until the real lighting after the repeat of several cycles of the glow discharge.

By this lighting, the tube voltage Vd decreases as shown in FIG. 22, and the turning-on operation of the starter S is not seen after the half cycle of the lighting. The discharge tube 1 lights until the lighting hold current at the half cycle is secured. The above operation is repeated at every half cycle of the power voltage V until the stable lighting condition is obtained.

Figure 23:
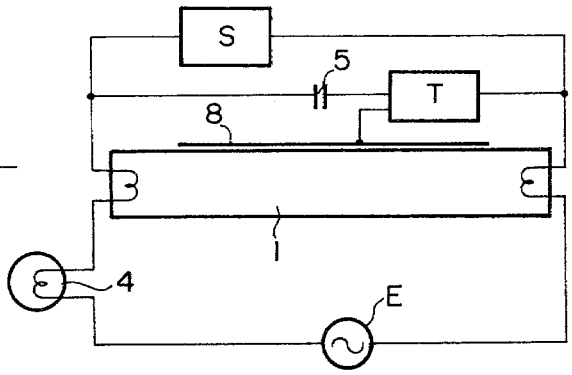
FIGS. 23 through 27 are circuit diagrams showing other embodiments of this invention developed from the fundamental circuit of FIG. 21.

Since the pulse transformer T is connected in series with the starter S in the preheating circuit, a preheating current flows through its primary coil in the preheating operation. The coil is therefore designed to allow the flow of the preheating current, which is disadvantageous in the designing of the transformer. Also, this is mainly due to the discharge current of the condenser 5 whose current varies considerably. In view of the above, the circuit of FIG. 23 is constructed, in which a series circuit of the transformer T and the condenser 5 is connected in parallel with the starter S. With this circuit, the charge and discharge current of the condenser 5 only flows through the primary coil of the transformer T, and thus can solve the problem. The operation and the function of the circuit is the same as the embodiment of FIG. 21.

In the above mentioned circuits of FIGS. 21 and 23, the timing of turning on of the starter S must be set to a later time than the time of the discharge start voltage in view of the change of the instantaneous value of the power voltage V at a half cycle. If the rise of the discharge start voltage according to the change of the environmental temperature of the discharge tube is to be taken into consideration, the time of turning on must be set around the peak of the half cycle.

It is useful to use as the starter S a reverse blocking triode thyristor (hereinafter referred to simply as an SCR abbreviated from silicon controlled thyristor) in which the time of turning on may easily be chosen. The embodiment of FIG. 24 uses an SCR, in which reference marks j, p and q are to show the corresponding connecting points in those in FIG. 21. The circuit elements having the same function as those in FIG. 21 are shown with the same numerals.

The SCR 21 of the starter S is provided with an igniting circuit by inserting a Zener diode 22 between its gate and anode. The anode of SCR 21 is connected with the power supply circuit. In order to secure a stable operation of the igniting circuit, a resistor 23 for regulating the igniting current is inserted in series in the circuit, and further a protecting resistor 24 is connected between the gate and cathode of the SCR.

According to this structure, when the instantaneous value in a half cycle of the power supply voltage V reaches the break-over voltage of the Zener diode 22, the diode 22 suddenly changes from its OFF state to the ON state and the gate current flows. The SCR 21 thereby turns on. By this operation, a preheating current flows and further a high voltage pulse is generated in the secondary coil of the pulse transformer T, whose primary coil receives the discharge current of the condenser 5. The generated high voltage pulse is applied to the outer wall of the discharge tube 1. In this time, the tube voltage Vd is lowered as shown in FIG. 22 and so the tube 1 does not ignite. Since the starter S is formed with the SCR 21 in the present circuit, the above operation occurs at every half cycle of the AC voltage by the reverse blocking characteristic of the SCR 21. At every other half cycle there is an interruption of the preheating operation, while a high tube voltage Vd is applied to the discharge tube 1 in proportion to the AC power voltage V at the half cycle of interruption. The lighting start characteristic is thus improved.

Figure 24:
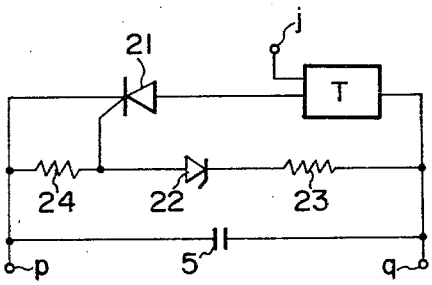

In the circuit arrangement of FIG. 24, the circuit elements are fewer and the circuit structure is simple, so that the device itself may be produced with low cost. On the other hand, according to this embodiment the time of turning on of the starter S, that is the time of turning on of the SCR 21 is determined by the break-over voltage of the Zener diode 22 with respect to the power voltage V, making its precise control is rather difficult.

Figure 25:
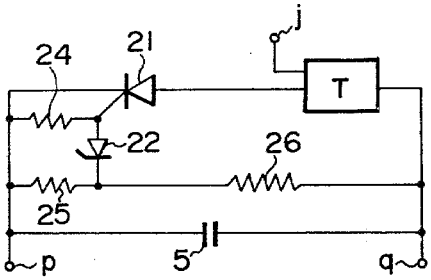

The circuit of FIG. 25 has been developed in order to solve this problem. According to this embodiment, the time may be determined rather freely. In the circuit of FIG. 25, a bleeder circuit for the power voltage is formed with resistors 25 and 26, and the Zener diode 22 is inserted in series between the output of the bleeder voltage and the gate electrode of SCR 21. Since the Zener diode 22 has a predetermined break-over voltage, the resistance of the resistors 25 and 26 may be varied. Thus the diode 22 may be operated with a divided voltage of the power voltage V and as the result, the time of turning on of the SCR 21 is determined to a desired time in the beginning of the half cycle of the power voltage V. In this case, the Zener diode 22 works as a trigger element for SCR 21, which therefore may be replaced with other trigger elements such as a diode thyristor.

Figure 26:
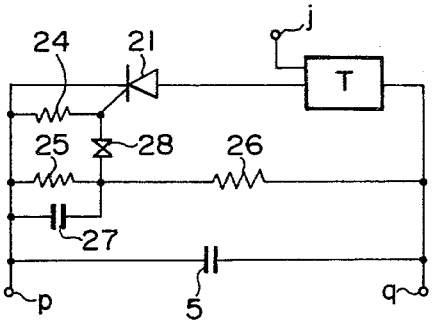

The circuit shown in FIG. 26 is a main part of the other embodiment of this invention. An igniting circuit of the SCR 21 is added to the bleeder circuit of the resistors 25 and 26, and further a condenser 27 for a time constant is connected in parallel with the resistor 25 of the bleeder circuit. For a trigger element in this case the diode AC thyristor (DIAC) is inserted in series between the output terminal of the bleeder voltage and the gate of SCR 21.

Due to the rise of the instantaneous value in a half cycle of the AC voltage V the time constant condenser 27 is charged with the bleeder voltage regulated by the resistors 25 and 26, and when the voltage between its electrodes reaches the break-over voltage $V_B$ of the DIAC 28, the SCR 21 is triggered to turn on. By the selection of the resistance of the bleeder circuit and the setting of the capacity of the time constant condenser 27, the time of turning on of the SCR 21 may be selected in a range exceeding the largest instantaneous value in the half cycle of the power voltage V, that is in the latter half range of the power voltage V, when the bleeder voltage is not lower than $V_B$ of the DIAC 28.

In the circuit arrangement of FIG. 25, the time of turning on of SCR 21 is limited to the beginning of the half cycle of the power voltage V (before reaching the ultimate instantaneous value). Further, it is much affected by a change of the power voltage V. Therefore if the time of turning on the SCR 21 is set around the ultimate instantaneous value of the half cycle taking into consideration the rise of the tube voltage $V_d$ by the change of the environmental temperature of the fluorescent discharge tube 1, the control of the turning on of the SCR 21 may not be done according to the decrease or change of the power voltage V. On the other hand, according to the circuit arrangement of FIG. 26, it is possible to control the turning on of the SCR 21 later in the half cycle over the ultimate instantaneous value during which the charging of the time constant condenser 27 proceeds. Thus the circuit of FIG. 26 is advantageous for change of the power voltage V.

In the above circuits showing the use of SCR 21 for its starter S, the position of the pulse transformer T in the circuit is shown as the same as that of FIG. 21. However, it should be noted that the insertion of the pulse transformer 7 as shown in FIG. 23 is also possible therein.

Whatever position the pulse transformer may take, the time of operation of the pulse transformer T is the time of turning on of SCR 21, and at that time the tube voltage $V_d$ of the discharge tube is lowered. Therefore, although the ionized electrons remain within the discharge tube due to the high voltage pulse generated by the operation of the transformer T and the lighting starts, the function of the transformer T is not sufficiently utilized at this stage. In view of the above, the inventor of this invention proposes the next embodiment shown in FIG. 27, in which the transformer T is operated at the half cycle of the power voltage V when the SCR 21 is not turned on, or when the discharge tube voltage Vd is sufficiently applied.

Figure 27:
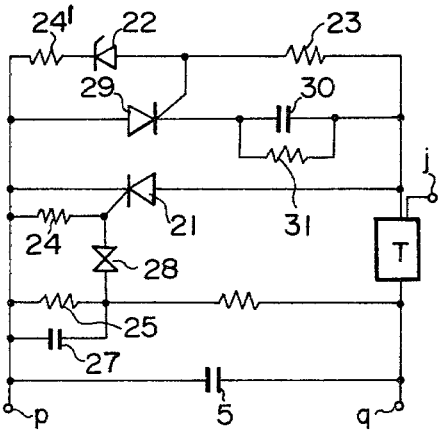

In the circuit of FIG. 27, a further SCR 29 of reverse polarity is connected in parallel with SCR 21 and the SCR 29 is connected in series with the parallel circuit of a condenser 30, for use in controlling the current of a small capacity, and its discharge resistor 31. Other than above, as an igniting circuit for SCR 29 the simplest arrangement of FIG. 24 using a Zener diode 22 is included in the circuit.

Figure 28:
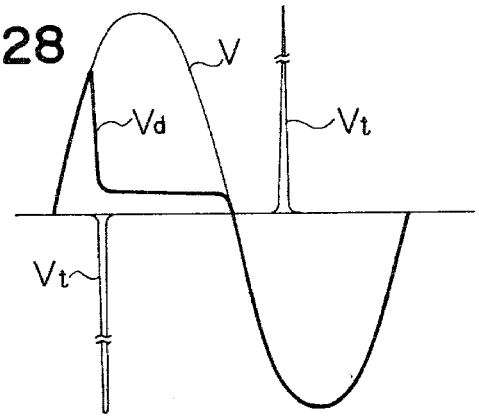
FIG. 28 is a graph showing the performance characteristic of the circuit of FIG. 27.

The operation of the half cycle of the AC power source in this circuit is the same as that of FIG. 26. The SCR 29 turns on in the next half cycle of the AC voltage, by which a current flows into the preheating circuit. The volume of the current is that controlled by the series condenser 30 and that charged by the condenser 5. When the SCR 29 turns on, the tube voltage Vd falls instantaneously but it immediately returns to the power voltage V. On the other hand, this instantaneous current flows in the primary coil of the pulse transformer T and thereby generates a high voltage pulse Vt in the secondary coil thereof. This is shown in FIG. 28.

According to the FIG. 26 circuit, in the half cycle the preheating operation is relayed, and according to the FIG. 27 circuit the high voltage pulse is generated in the half cycle. Since the tube voltage Vd which can return instantaneously is sufficiently applied to the circuit, very good lighting operation is assured with the high voltage pulse operation just before the recovery. In this case, the influence of the turning on of SCR 29 on the tube voltage is small, and the rise of the tube voltage due to the change of the environmental temperature need not be considered when the turning on voltage of SCR 29 is set to the lower value than the lighting start voltage at the normal temperature. If the pulse transformer T is to be operated only when the SCR 29 turns on, the pulse transformer T may only be inserted in series with the series circuit of SCR 29 and the condenser 30.

Figure 29:
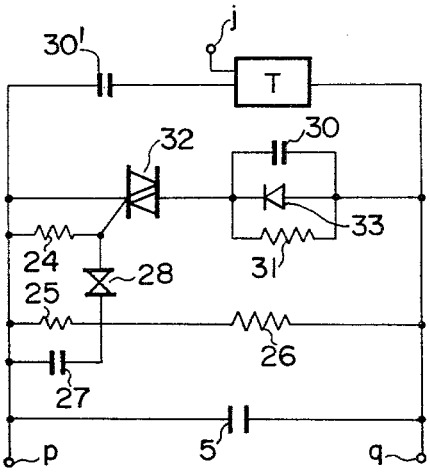
FIG. 29 is a circuit diagram of a further embodiment whose characteristic is as shown in FIG. 28.

A further embodiment of this invention is shown in the circuit of FIG. 29, in which a series connection is formed between the bi-directional triode thyristor (TRIAC) 32 and a diode 33. The circuit includes a starter S and another switch of SCR 29 shown in FIG. 27. The circuit arrangement of FIG. 29 is the same as that of FIG. 27, except that a current controlling condenser 30 and a discharging resistor 31 are connected with the diode 33 respectively in parallel.

In the circuit arrangement of FIG. 29, on closing of the power, the time constant condenser 27 is charged under the turning on the bleeder circuit of resistors 25 and 26, and the diode AC switch 28 turns on in the half cycle of the AC power. Gate current is applied to the triode AC switch 32 to turn it ON. In this state, if it is the half cycle range wherein a forward voltage is applied to the triode AC switch 32 against the diode 33 connected in series with the triode AC switch 32, the switch 32 flows the preheating current of the phase control type with the forward current flowing through the diode 33. Also with the discharge current of the condenser 5 the pulse transformer T operates.

In the next half cycle of the AC power in this operation, when the triode AC switch 32 is changed into the ON state by the constant condenser 27, a backward voltage is applied to the diode 33. Therefore the current is blocked by the diode 33, while a pulsewise current of small capacity flows through the current controlling condenser 30. When the charging of the condenser 30 ends, the current is controlled, and the triode AC switch 32 now cannot hold its ON state, and at once switches to OFF. By this operation, the discharge current of the condenser 5 flows into the pulse transformer T and generates a high voltage pulse in its secondary coil. This circuit operation is the same as the circuit characteristic shown in FIG. 28 for the circuit of FIG. 27 and an effective starting of lighting is made by the circuit arrangement of FIG. 29.

The triode thyristor which is controllable with the gate current is good in the time characteristic of the change of current at the time of change into the ON state and also in the reverse blocking characteristic. The secondary output of the pulse transformer controlled therefore shows a single pulse at every half cycle and is good in the rising characteristic as shown in FIG. 28. Its pulse width is narrow. On the other hand, the trigger voltage for starting the lighting of the fluorescent discharge tube may better be of a wide pulse width.

The break-over voltage of the diode thyristor cannot be chosen freely. As already explained, it may not be used, as it is, in the circuit of this invention. If the diode thyristor and the pulse transformer T are used together, there arises a transient current caused by the avalanche at the time of the break over, by which an oscillating high voltage pulse of high frequency is generated as an output from the secondary coil of the pulse transformer T.

Figure 30:
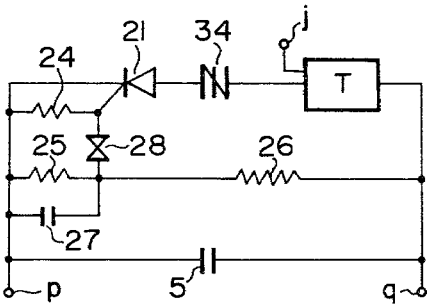
FIG. 30 is a circuit diagram showing a further different embodiment of the present invention.
Figure 31:
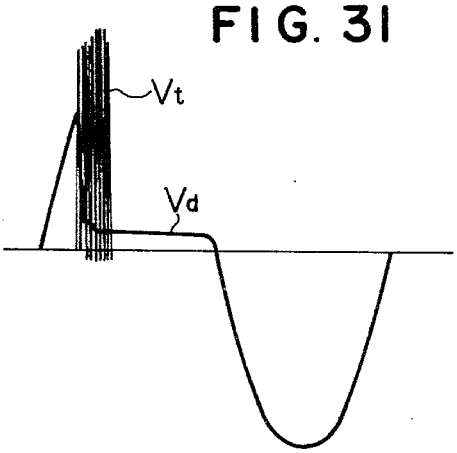
FIG. 31 is a graph of the performance characteristic of the circuit of FIG. 30.

According to this invention, the above characteristic of the diode thyristor is fully utilized in the circuit of FIG. 30. In this circuit, an SSS element 34 is connected in series with the SCR 29 of the FIG. 26 circuit. The circuit operation of this circuit is the same as that of FIG. 26, but the high voltage pulse Vt from the secondary coil of the pulse transformer T is generated as an oscillating pulse of high frequency as shown in FIG. 31, which works effectively in the ignition of the fluorescent discharge tube. In this case, the time of control of the preheating circuit current is determined by the turn on operation of SCR 29, an SSS with relatively high break-over voltage $V_B$ may only be used, without considering the break-over voltage $V_B$.

The diode thyristors of this kind may be used for the circuit of this invention. Particularly, for the switching components using the SCR 29 as shown in FIG. 27, a single diode thyristor or a series combination thereof with a diode may effectively be used.

It should be realized that a part of the circuit elements in the circuits according to this invention may be replaced with other elements as above mentioned.

For example, for the ignition of an FCL-30 type fluorescent discharge tube 1, a 100 W incandescent bulb 4 under the rated voltage of the power voltage may be used. The capacitance of the condenser 5 is 0.2 $\mu$F, the capacitance of the time constant condenser is 0.1 $\mu$F and a predetermined resistance for getting the circuit constant is used. The pulse transformer T used comprises a primary coil of ten to twenty turns and a secondary coil of 300 to 500 turns with a ferrite core. At the normal temperature it ignites within one second of the preheating operation, and when the environmental temperature is between 0° and 40° C., the preheating time is about two seconds. The lighting device according to this invention is good for practical use with $\pm 10\%$ of change of the power voltage.

Many modifications and variations of the present invention are possible other than the above embodiments in the light of the above teachings. It is therefore to be understood that within the scope of the appended claims the invention may be practiced otherwise than as specifically described.

What I claim is:

1. A fluorescent lighting device, comprising:

(a) a fluorescent discharge tube having preheating electrodes and an outer wall including auxiliary electrode means adjacent thereto;

(b) resistive stabilizing means connected in series with said preheating electrodes;

(c) a bimetal glow bulb igniter coupled across the preheating electrodes of said discharge tube, a preheating current flowing through said preheating electrodes, resistive means and igniter to preheat said discharge tube;

(d) a capacitor, said capacitor minimizing propagation of electromagnetic noise radiated by said igniter into the environment surrounding said lighting device; and (e) a pulse transformer having a low voltage primary coil and a high voltage secondary coil, the primary coil of said pulse transformer being connected in series with said capacitor and said secondary coil being connected to said auxiliary electrode means, said series-connected capacitor and primary coil being connected in parallel with said glow bulb igniter, the primary coil of said pulse transformer having a high frequency surge voltage induced therein upon termination of said preheating current and said secondary coil applying a stepped-up high voltage to said auxiliary electrode means thereby initiating a discharge within said discharge tube.

2. A fluorescent lighting device, comprising:

(a) a fluorescent discharge tube having preheating electrodes and an outer wall including auxiliary electrode means adjacent thereto;

(b) resistive stabilizing means connected in series with said preheating electrodes;

(c) a bimetal glow bulb igniter;

(d) a capacitor coupled in parallel with said preheating electrodes, said capacitor minimizing propagation of electromagnetic noise radiated by said igniter into the environment surrounding said lighting device; and (e) a pulse transformer having a low voltage primary coil and a high voltage secondary coil, the primary coil of said pulse transformer being connected in series with said glow bulb igniter and said secondary coil being connected to said auxiliary electrode means, said series-connected glow bulb igniter and said primary coil being connected in parallel with said capacitor, a preheating current flowing through said preheating electrodes, resistive means, igniter and primary coil to preheat said discharge tube, the primary coil of said pulse transformer having a high frequency surge voltage induced therein upon termination of said preheating current and said secondary coil applying a stepped-up high voltage to said auxiliary electrode means thereby initiating a discharge within said discharge tube.

3. A fluorescent lighting device according to claim 1 or 2, wherein one end of the secondary coil of said pulse transformer is connected with one end of the primary coil.

4. A fluorescent lighting device according to claim 3 wherein said auxiliary electrode means comprises the secondary coil of said pulse transformer.

5. A fluorescent lighting device according to claim 2, wherein both ends and an intermediate outgoing lead of the secondary coil of the pulse transformer are connected respectively with auxiliary electrode means including three conductors sequentially provided at the outer wall of said fluorescent discharge tube, so as to apply different voltages to the outer wall of said fluorescent discharge tube.

6. A fluorescent lighting device comprising:

(a) a fluorescent discharge tube having a pair of preheating electrodes and an outer wall;

(b) resistive stabilizing means connected in series with said preheating electrodes;

(c) a capacitor coupled across the preheating electrodes of said discharge tube;

(d) a starter including a thyristor having first and second electrodes and a gate electrode, said gate electrode being controlled by a power source and said first electrode being coupled to one of said pair of preheating electrodes;

(e) a pulse transformer having a low voltage primary coil and a high voltage secondary coil, one end of the primary coil of said pulse transformer being connected to the second electrode of said thyristor and the other end of said primary coil to the other of said preheating electrodes, the charge and discharge currents of said capacitor flowing in said primary coil and thereby generating a stepped-up voltage across said secondary coil when said thyristor is switched on; and (f) an auxiliary electrode adjacent the outer wall of said fluorescent discharge tube, said auxiliary electrode being coupled to the secondary coil of said pulse transformer.

7. A fluorescent lighting device according to claim 6 which further comprises a resistor between the gate and first electrode of said thyristor and a Zener diode between the gate of said thyristor and the other preheating electrode of the fluorescent discharge tube.

8. A fluorescent lighting device according to claim 6, which further comprises first and second series-connected resistors connected between the preheating electrodes of said fluorescent discharge tube and a constant voltage diode coupling the gate of said thyristor to the junction of said first and second resistors.

9. A fluorescent lighting device according to claim 6, wherein a pair of thyristors are provided as the starter, the thyristors being connected in the opposite directions with respect to one another between the preheating electrodes of the fluorescent discharge tube and generating a kick pulse for each half cycle of the AC power.

10. A fluorescent lighting device according to claim 2 which further comprises a second capacitor coupled across the preheating electrodes of said discharge tube;

a second bimetal glow bulb-igniter;

second auxiliary electrode means adjacent the outer wall of said fluorescent discharge tube;

a second pulse transformer having a low voltage primary coil and a high voltage secondary coil, the primary coil of said second pulse transformer being connected in series with said second bimetal glow bulb igniter and said secondary coil being connected to said secondary electrode, said series-connected second glow bulb igniter and the primary coil of said second pulse transformer being connected in parallel with said second capacitor, a preheating current flowing through said resistive means to a first series connection including one of said preheating electrodes, the primary coil of the first pulse transformer and the first bulb igniter, and to a second series connection including the other of said preheating electrodes, the primary coil of the second pulse transformer and the second bulb igniter, the primary coils of said pulse transformers having high frequency surge voltages induced therein upon termination of said preheating currents and said secondary coils applying stepped up high voltages to respective ones of said auxiliary electrode means.

11. A fluorescent lighting device according to claim 1 which further comprises a second bimetal glow bulb igniter and an impedance element, said impedance element being coupled in parallel with said second glow bulb igniter, the first bimetal glow bulb igniter being connected in series with the parallel connected second bulb igniter and impedance element, said series connection being coupled across said preheating electrodes.

12. A fluorescent lighting device according to claim 1 which further comprises a second fluorescent discharge tube having preheating electrodes and an outer wall including second auxiliary electrode means adjacent thereto; and a second bimetal glow tube igniter, said second tube igniter being coupled across the preheating electrodes of said second fluorescent discharge tube, a preheating current flowing through said resistive means, a first preheating electrode of the first fluorescent discharge tube, the first bimetal glow tube igniter, a second preheating electrode of the first fluorescent discharge tube, a first preheating electrode of the second fluorescent discharge tube, said second bimetal glow tube igniter and a second preheating electrode of said second fluorescent discharge tube, the secondary coil of said pulse transformer being further connected to said second auxiliary electrode means.

13. A fluorescent lighting device according to claim 1 which further comprises a second fluorescent discharge tube having preheating electrodes and an outer wall including second auxiliary electrode means adjacent thereto; and a semiconductor diode coupled across the preheating electrodes of said second fluorescent discharge tube, a preheating current flowing through said resistive means, a first preheating electrode of the first fluorescent discharge tube, the bimetal glow tube igniter, a second preheating electrode of the first fluorescent discharge tube, a first preheating electrode of the second fluorescent discharge tube, the semiconductor diode and a second preheating electrode of said second fluorescent discharge tube, one end of the secondary coil of said pulse transformer being connected to said second auxiliary electrode means in addition to said first auxiliary electrode means.

14. A fluorescent lighting device according to claim 1 or 2 wherein said resistive means is an incandescent bulb.

15. A fluorescent lighting device comprising:

(a) a fluorescent discharge tube having a pair of preheating electrodes and an outer wall;

(b) resistive stabilizing means connected in series with said preheating electrodes;

(c) a starter coupled across said pair of preheating electrodes;

(d) a capacitor;

(e) a pulse transformer having a low voltage primary coil and a high voltage secondary coil, the primary of said pulse transformer being connected in series with said capacitor, said series-connected capacitor and primary coil being connected in parallel with said starter, the charge and discharge currents of said capacitor flowing in said primary coil thereby generating a stepped-up voltage across said secondary coil when said starter is switched on; and (f) an auxiliary electrode adjacent the outer wall of said fluorescent discharge tube, said auxiliary electrode being coupled to the secondary coil of said pulse transformer.

* * * * *